US005240161A

United States Patent [19]

Kaneko

[11] Patent Number: 5,240,161

[45] Date of Patent: Aug. 31, 1993

[54] FASTENER GUIDE MECHANISM IN FASTENER DRIVING TOOL

[75] Inventor: Tetsuhisa Kaneko, Anjo, Japan

[73] Assignee: Makita Corporation, Anjo, Japan

[21] Appl. No.: 946,891

[22] Filed: Sep. 18, 1992

[30] Foreign Application Priority Data

Sep. 21, 1991 [JP] Japan ..... 3-269978

[51] Int. Cl.[5] ..... B25C 1/04

[52] U.S. Cl. ..... 227/109; 227/136

[58] Field of Search ..... 227/109, 120, 136, 127, 227/128, 119

[56] References Cited

U.S. PATENT DOCUMENTS

| | | | |
|---|---|---|---|
| 3,708,097 | 1/1973 | Fisher | 227/136 |
| 3,945,551 | 3/1976 | Sato et al. | 227/136 |
| 4,442,965 | 4/1984 | Leistner | 227/136 |
| 4,942,996 | 7/1990 | Wolfberg et al. | 227/136 |

*Primary Examiner*—Scott Smith

*Attorney, Agent, or Firm*—Dennison, Meserole, Pollack & Scheiner

[57] ABSTRACT

A fastener guide mechanism in a fastener driving tool includes a door member for closing an opening formed on one of the lateral sides of a fastener guide having a driver guide and a fastener guide. The fastener guide includes therein a fastener guide channel. A fastener feeding device having a fastener feeding member moves the fasteners connected by a carrier and disposed in the fastener guide channel forwardly toward the driver guide track of the driver guide one after another. A pressing member is mounted on the door member for pressing the connected fasteners on the fastener feeding member. The pressing member is operable to contact the connected fasteners at a first position when the connected fasteners are of a first kind. The pressing member is operable to contact the connected fasteners at a second position separated from the first position in a direction away from the fastener guide channel. The pressing member is biased by a biasing member for normally biasing toward the connected fasteners. A stopper member prevents movement of the pressing member from the first position in a direction away from the fastener guide channel.

3 Claims, 4 Drawing Sheets

FASTENER GUIDE MECHANISM IN FASTENER DRIVING TOOL

BACKGROUND OF THE INVENTION

1. Field of the Invention

The present invention relates to a fastener guide mechanism in a fastener driving tool.

2. Description of the Prior Art

A conventional fastener driving tool includes a driver guide within which a driver is reciprocally driven for driving fasteners such as nails. The fasteners are stored in a magazine and are connected in series by a carrier. The fasteners connected by the carrier are fed into the fastener guide track one after another through a fastener feeding channel formed in a fastener guide connected to the driver guide.

The carrier may be formed by various materials such as thin wires and a belt made of synthetic resin, and therefore the thickness of the carrier varies with the type of its material. For example, the carrier made of thin wires has a smaller thickness than one formed by a belt made of synthetic resin.

For the above reason, it is proposed to adjust the width of the fastener feeding channel, depending on the type of the carrier. Japanese Utility Model Publication No. 1-21732 discloses a door plate biased by a spring for changing the width of the fastener feeding channel, depending on the type of the carrier. Japanese Utility Publication No. 53-47254 and Japanese Laid-Open Utility Model Publication No. 63-197075 disclose use of a spacer for adjusting biasing force of a guide member.

However, with the former prior art mechanism, the biasing force of the spring varies with the type of the carrier of fasteners because of change of thickness. Therefore, in case that the spring is determined to have a relatively strong biasing force required for the carrier made of wires, a stronger biasing force is applied to the carrier if the fasteners have been changed to those carried by the carrier formed by a belt made of synthetic resin. This may prevent the fasteners from being smoothly fed toward the driver guide track. On the other hand, in case that the spring is determined to have a relatively small biasing force, a smaller biasing force is applied to the carrier if the fasteners have been changed to those carried by the carrier made of wires. This may cause unstable support of the fasteners, and the fasteners cannot be smoothly fed toward the driver guide track. In either of these cases, it is very difficult to determine the biasing force to an appropriate value.

Further, with the latter prior art mechanism, the biasing force can be adjusted according to change of the carrier carrying the fasteners by changing the restraining position of the guide member. However, such adjusting operation must be manually performed after the operator has recognized the kind of the fasteners or the kind of the carrier within a fastener feeding channel.

SUMMARY OF THE INVENTION

It is, accordingly, an object of the present invention to provide a fastener guide mechanism in a fastener driving tool which can reliably guide fasteners within a fastener feeding channel irrespective of the kind of a carrier carrying the fasteners.

It is another object of the present invention to provide a fastener guide mechanism in a fastener driving tool which includes a pressing member operable to automatically change its position for applying an appropriate biasing force to fasteners according to change of the kind of a carrier carrying the fasteners.

According to the present invention, there is provided a fastener guide mechanism in a fastener driving tool including a guide member having a driver guide and a fastener guide, the driver guide having therein a driver guide track within which a driver is reciprocally moved to drive the fasteners connected in series by a carrier, and the fastener guide having therein a fastener guide channel one end of which is connected to the driver guide and the other end of which is connected to the inside of a magazine, comprising:

a door member for closing an opening formed on one of the lateral sides of the fastener guide;

a fastener feeding device having a fastener feeding member for moving the connected fasteners in the fastener guide channel forwardly toward the drive guide track one after another;

a pressing member mounted on the door member for pressing the connected fasteners on the fastener feeding member, the pressing member being operable to contact the connected fasteners at a first position when the connected fasteners within the fastener guide channel are of a first kind, and being operable to contact the connected fasteners within the fastener guide channel at a second position separated from the first position in a direction away from the fastener guide channel;

a biasing member for normally biasing the pressing member toward the connected fasteners; and a stopper member for limiting movement of the pressing means from the first position in a direction away from the fastener guide channel.

The invention will become more fully apparent from the claims and the description as it proceeds in connection with the drawings.

DETAILED DESCRIPTION OF THE PREFERRED EMBODIMENT

Figure 1:
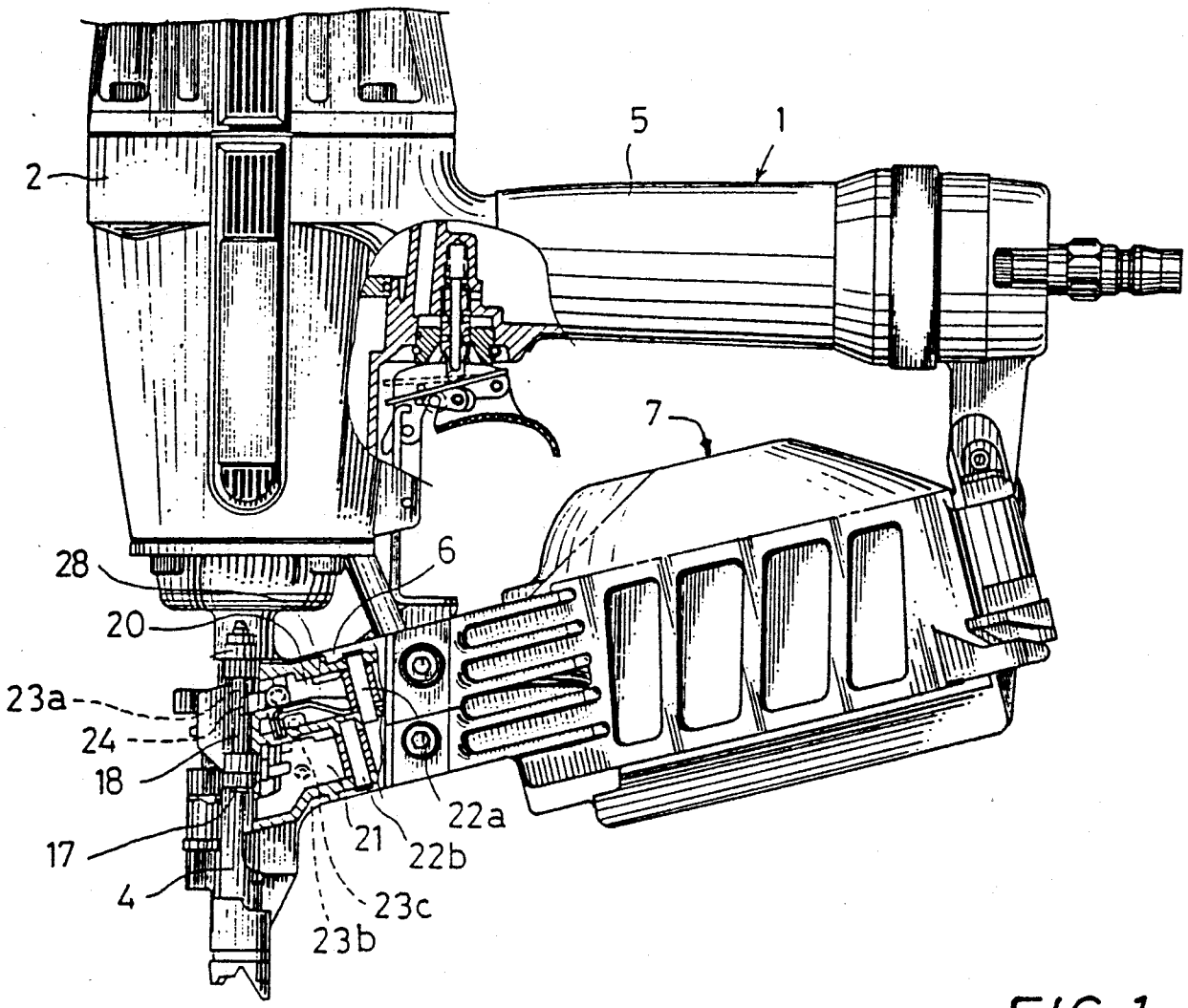
FIG. 1 is a side view, with a part broken away, of a fastener driving tool including a fastener guide mechanism according to an embodiment of the present invention.

Referring to FIG. 1, there is shown a fastener driving tool 1 including a fastener guide mechanism according to an embodiment of the present invention. The fastener driving tool 1 is constructed to reciprocally move a piston (not shown) within a body 2 through compressed air supplied from an air source. The piston is connected to a driver (not shown) movable along a fastener drive track 3 formed in a driver guide 4 which is mounted on a lower portion of the body 2. A handle 5 is connected to the central portion of the body 2 and extends substantially perpendicular to the body 2. A fastener guide 6 extends from the driver guide 4 substantially in parallel to the handle 5. A cylindrical magazine 7 is mounted on a rear end of the fastener guide 6 and accommodates a plurality of fasteners W1 connected in series by wires (hereinafter called "connected fasteners W1") or a plurality of fasteners W2 connected in series by a belt made of synthetic resin (hereinafter called "connected fasteners W2"). The connected fasteners W1 or W2 are coiled within the magazine 7 and are unwound to extend to the driver guide track 3 through a fastener guide channel 19 formed within the fastener guide 6 as will be hereinafter explained.

Figure 5:
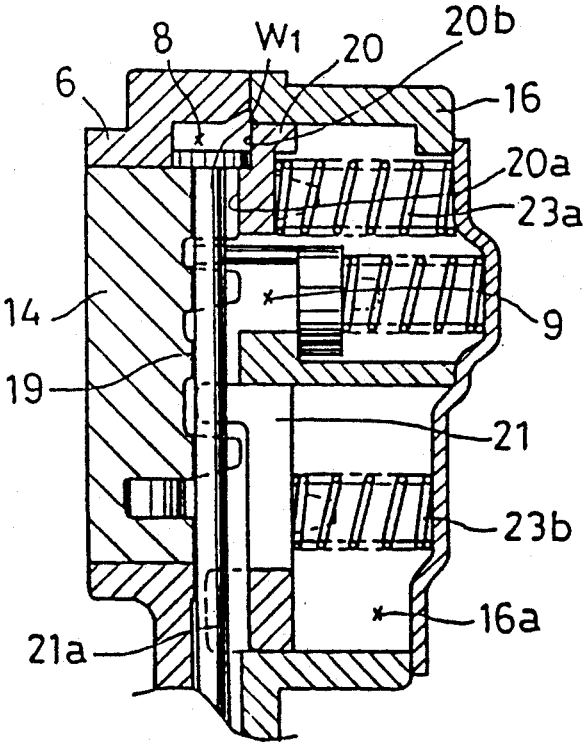
FIG. 5 is a sectional view taken along line V—V in FIG. 2.

As shown in FIG. 5, the fastener guide 6 includes at its upper portion a recess 8 for guiding a head portions of the connected fasteners W1 or W2. The fastener guide 6 includes at its forward portion a window 9 through which a fastener feeding arm 14 of a fastener feeding device 10 extends into the fastener guide channel 19 from the outside.

Figure 2:
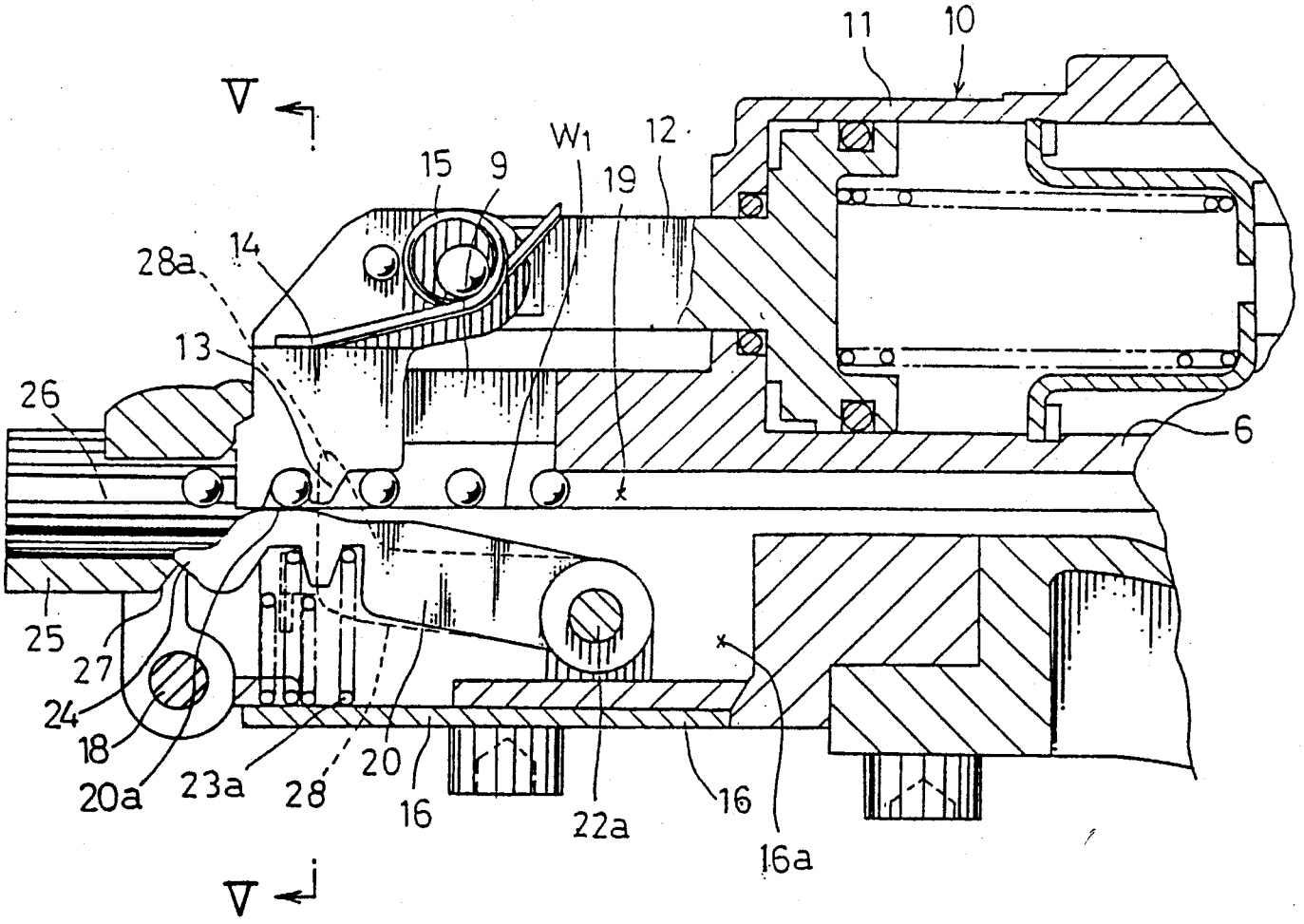
FIG. 2 is an enlarged sectional view of the fastener guide mechanism shown in FIG. 1.
Figure 3:
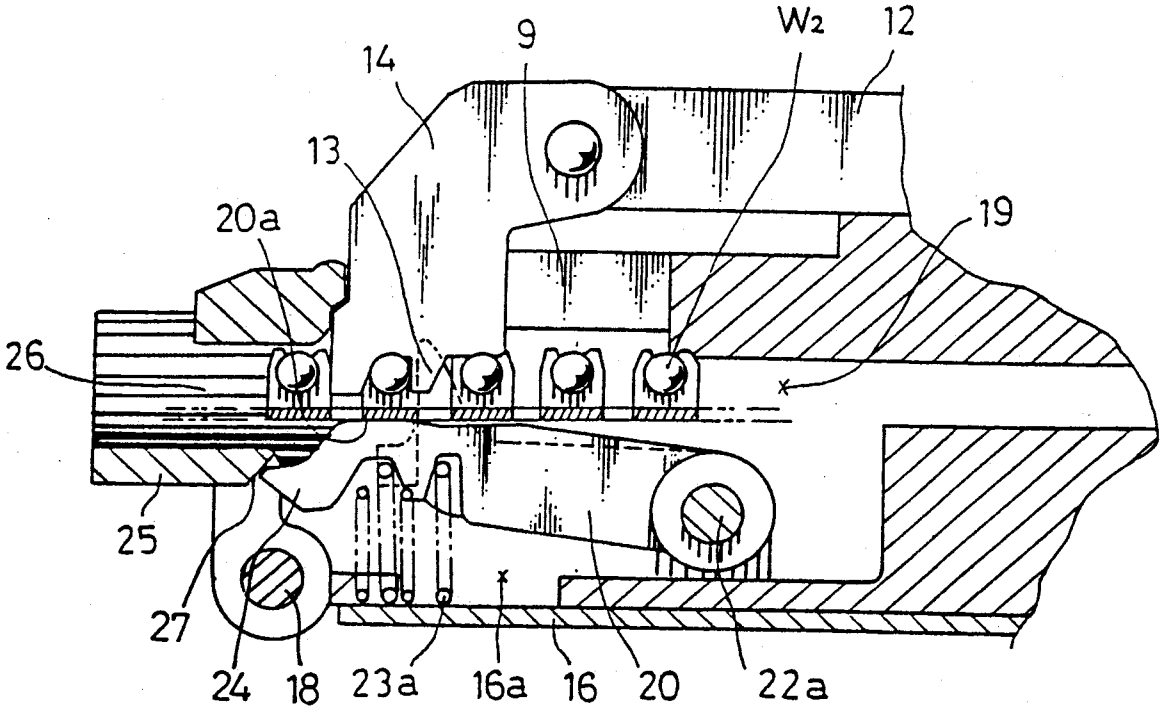
FIG. 3 is a view similar to FIG. 2 but showing different operation.

As shown in FIG. 2, the fastener feeding device 10 includes a cylinder 11 mounted on the outside of the fastener guide 6. A rod 12 is slidably inserted into the cylinder 11 and extends along the fastener guide 6. One end of the fastener feeding arm 14 is pivotally mounted on the forward portion of the rod 12. A pawl 13 for engagement with the connected fasteners W1 or W2 is formed with the other end of the fastener feeding arm 14. The fastener feeding arm 14 is biased by a spring 15 in a counterclockwise direction in FIG. 2 in such a manner that the pawl 13 protrudes into the fastener guide channel 19. The fastener guide 6, the magazine 7 and a part of the driver guide 4 are opened at one lateral side and are closed by a door member 16. The door member 16 forms the fastener feeding channel 19 in cooperation with the fastener guide 6 when it is closed. The fastener feeding channel 19 has a width slightly greater than the width of the connected fasteners W2 or the width of the carrier made of synthetic resin. As shown in FIG. 1, the door member 16 has a forward end which is pivotally supported by a bracket 17 integrally formed with the driver guide 4 through a vertical shaft 18, so that the door member 16 can be operated to open or close the fastener feeding channel 19.

Figure 4:
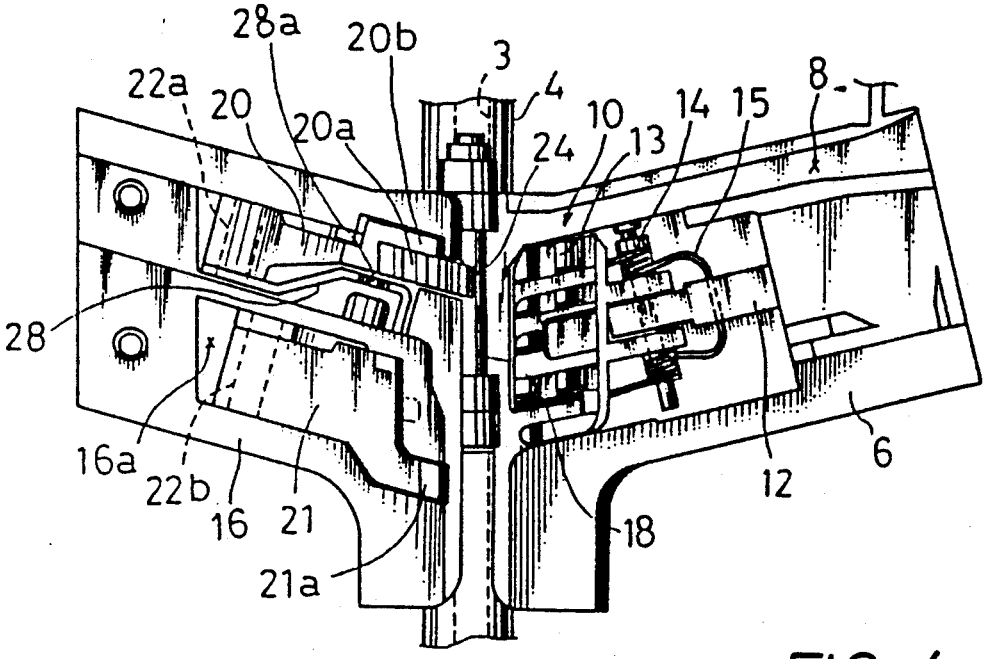
FIG. 4 is a side view of the fastener guide mechanism with a door member opened.

As shown in FIG. 5, the door member 16 includes a recess 16*a* disposed in opposed relationship with the window 9 of the fastener guide 6. As shown in FIG. 4, a pressing member 20 and a first stopper member 21 are pivotally supported within the recess 16*a* through shafts 22*a* and 22*b*, respectively, and are positioned in juxtaposed relationship with each other in a vertical direction. The pressing member 20 and the first stopper member 21 are biased by compression springs 23*a* and 23*b* in a direction toward the fastener guide channel 19, respectively. The compression springs 23*a* and 23*b* are interposed between substantially the middle portions of the pressing member and the first stopper member 21 and the bottom wall of the recess 16*a*, respectively. A second stopper member 28 is disposed between the pressing member 20 and the first stopper member 21 and is pivotally mounted on the shaft 22*a*. The second stopper member 28 is biased by a spring 23*c* in a direction toward the fastener guide channel 19. The first and second stopper member 21, 28 include pawls 21*a* and 28*a*, respectively, for engagement with the connected fasteners W1 or W2.

A substantially flat pressing surface 20*a* is formed on the end portion of the pressing member 20 on the side of the fastener guide channel 19 for pressing on the connected fasteners W1 or W2. A bill-like engaging portion 24 is formed on the extremity of the end portion of the pressing member 20 and is engageable with a stopper portion 25 formed on a part of the driver guide 4 which defines a front edge of the opening closed by the door member 16. The stopper portion 25 includes a inner first surface 26 and an outer second surface 27 intersecting to each other. The first surface 26 extends in parallel with the fastener guide channel 19. The second surface 27 extends obliquely relative to the first surface 26.

Here, the length of the pressing member 20 is determined in such a manner that the engaging portion 24 may extend forwardly by a short distance beyond the edge of the stopper portion 25 when the door member 16 is closed to reach a first position. However, if no load has been applied to the spring 23*a*, the position of the pressing member 20 relative to the door member 16 is maintained by the spring 23*a* to permit movement of the engaging portion 24 toward the fastener guide channel 19 beyond the stopper portion 25 as the door member is closed. Further, the positional relationship between the pressing member 20 and the engaging portion 24 is determined as follows:

In case that the connected fasteners W1 or the fasteners connected by wires are positioned with the fastener guide channel 19, as the door member 16 is pivoted to close the fastener guide channel 19, the engaging portion 24 moves toward the fastener guide channel 19 beyond the stopper portion 25. The pressing surface 20*a* of the pressing member 20 subsequently contacts the connected fasteners W1 and the engaging portion 24 is engaged by the first surface 26 of the stopper portion 25 when the door member 16 is closed.

In case that the connected fasteners W2 or the fasteners connected by the belt made of synthetic resin, as the door member 16 is pivoted to close the fastener guide channel 19, the pressing surface 20*a* firstly contacts the connected fasteners W2 where the engaging portion 24 is positioned outwardly of the stopper portion 25. Thus, the engaging portion 24 cannot be moved toward the fastener guide channel 19 beyond the stopper portion 25. When the door member 16 has been closed, the engaging portion 24 is engaged by the second surface 27 of the stopper portion 25 or is spaced outwardly from the second surface 27 by a short distance. Thus, in this case, the distance between the pressing surface 20*a* and the fastener feeding member 14 becomes larger than in the above described case.

Additionally, as shown in FIG. 5, the pressing member 20 further includes an abutting surface 20*b* formed in series with the upper portion of the pressing surface 20*a* via a stepped portion. The abutting surface 20*b* is disposed in opposed relationship with the recess 8 of the guide member 6 and provides a guide for the last one of the connected fasteners W1.

The operation of the above embodiment will now be explained. The connected fasteners W1 or W2 stored in the magazine 7 are unwound to enter the fastener guide channel 19. The fastener feeding mechanism 10 is operated to feed the connected fasteners W1 or W2 one after another into the driver guide track 3 through movement of the fastener feeding member 14 which engages the fastener by its pawl 13 in such a manner that the fastener is caught by the pawl 13. During such feeding operation, the fasteners themselves of the connected fasteners W1 or W2 move the stopper members 21 and 28 to pivot the same away from the connected fasteners W1 or W2. Upon completion of one stroke of feeding movement, the pawls 21*a* and 28*a* protrude into a space between two adjacent fasteners so as to prevent the connected fasteners W1 or W2 from moving in a reverse direction.

This feeding operation is performed with the connected fasteners W1 or W2 resiliently held between the pressing member 20 and the feeding member 14. The operation of the pressing member 20 is explained as follows:

In case that the connected fasteners W1 or the fasteners connected by wires are positioned with the fastener guide channel 19, as the door member 16 is pivoted to close the fastener guide channel 19, the engaging portion 24 moves toward the fastener guide channel 19 beyond the stopper portion 25 and is automatically engaged by the first surface 26 of the stopper portion 25 when the door member 16 is closed. At this position, the fastener guide channel 19 has smaller width, and the pressing member 20 is prevented from moving toward the door member 16 and presses the connected fasteners W1 on the fastener feeding member 13 through the pressing surface 20*a*. Thus, the pressing member 20 can reliably press the connected fasteners W1 according to their thickness and the connected fasteners W1 can be smoothly guided.

Additionally, since the head of the last one of the connected fasteners W1 within the fastener guide channel 19 can be guided by the abutting surface 20*b* of the pressing member 20 opposed to the recess 8, the last one of the connected fasteners W1 can be reliably guided.

In case of the connected fasteners W2 or the fasteners connected by the belt made of synthetic resin, as the door member 16 is pivoted to close the fastener guide channel 19, the engaging portion 24 does not move toward the fastener guide channel 19 beyond the stopper portion 25, and it is engaged by the second surface 27 of the stopper portion 25 or is spaced outwardly from the second surface 27 by a short distance when the door member 16 is closed. At this situation, the pressing member 20 presses the connected fasteners W2 with fastener guide channel 19 kept to have a greater width. Thus, the pressing member 20 can reliably press the connected fasteners W2 according to their thickness and the connected fasteners W2 can be smoothly guided.

While the invention has been described with reference to a preferred embodiment thereof, it is to be understood that modifications or variations may be easily made without departing from the scope of the present invention which is defined by the appended claims.

What is claimed is:

1. A fastener guide mechanism in a fastener driving tool including a guide member having a driver guide and a fastener guide, the driver guide having therein a driver guide track within which a driver is reciprocally moved to drive the fasteners connected in series by a carrier, and the fastener guide having therein a fastener guide channel one end of which is connected to the driver guide and the other end of which is connected to the inside of a magazine, comprising:

a door member for closing an opening formed on a lateral side of the fastener guide;

fastener feeding means having a fastener feeding member for moving the connected fasteners in the fastener guide channel forwardly toward the driver guide track one after another;

a pressing member having two ends and being mounted on said door member for pressing the connected fasteners on said fastener feeding member, said pressing member being operable to contact the connected fasteners at a first position when the connected fasteners within the fastener guide channel are of a first kind, and being operable to contact the connected fasteners within the fastener guide channel at a second position separated from said first position in a direction away from the fastener guide channel when the connected fasteners within the fastener guide channel are of a second kind;

biasing means for normally biasing said pressing member toward the connected fasteners;

stopper means for limiting movement of said pressing means from said first position in a direction away from the fastener guide channel;

said pressing member is pivotally mounted on said door member at one end and includes a pressing portion for abutting on the connected fasteners on a side of the other end; said other end includes an engaging portion for engagement with the stopper means;

said stopper means includes a stopper member formed on the guide member to define a part of an edge of the opening of the guide member, said stopper member includes a first stopper surface on a side of the fastener guide channel for engagement with said engaging portion of said pressing member positioned at said first position; and said stopper member includes a second stopper surface directed outwardly from said fastener guide channel for limiting movement of said pressing member positioned at said second position in a direction toward the fastener guide channel.

2. The mechanism as defined in claim 1 wherein said biasing means is a spring interposed between said door member and said pressing member.

3. A fastener guide mechanism in a fastener driving tool including a guide member having a driver guide and a fastener guide, the driver guide having therein a driver guide track within which a driver is reciprocally moved to drive the fasteners connected in series by a carrier, and the fastener guide having therein a fastener guide channel one end of which is connected to the driver guide and the other end of which is connected to the inside of a magazine, comprising:

a door member for closing an opening formed on a lateral side of the fastener guide, said door member has a forward end which is pivotally supported on the driver guide;

fastener feeding means having a fastener feeding member for moving the connected fasteners in the fastener guide channel forwardly toward the driver guide track one after another;

a pressing member having two ends and being mounted on said door member for pressing the connected fasteners on said fastener feeding member, said pressing member being operable to contact the connected fasteners at a first position when the connected fasteners within the fastener guide channel are of a first kind, and being operable to contact the connected fasteners within the fastener guide channel at a second position separated from said first position in a direction away from the fastener guide channel when the connected fasteners within the fastener guide channel are of a second kind;

biasing means for normally biasing said pressing member toward the connected fasteners;

stopper means for limiting movement of said pressing means from said first position in a direction away from the fastener guide channel;

said pressing member is pivotally mounted on said door member at one end and includes a pressing portion for abutting on the connected fasteners on a side of the other end; said other end includes an engaging portion for engagement with the stopper means;

said stopper means includes a stopper member formed on the guide member to define a part of an edge of the opening of the guide member; said stopper member includes a first stopper surface on a side of the fastener guide channel for engagement with said engaging portion of said pressing member positioned at said first position;

said forward end of the door member is disposed forwardly of said stopper member; the length of said pressing member is determined in such a manner that said engaging portion of said pressing member extends forwardly by a short distance beyond the edge of said stopper member when said door member is closed; said engaging portion of said pressing member moves beyond said stopper member edge inwardly toward the fastener guide channel through the lateral opening of said fastener guide to reach said first position as said door member is closed in case that said first kind of the connected fasteners is disposed within the fastener guide channel; and said engaging portion of said pressing member moves beyond said stopper member edge outwardly away from the fastener guide channel without entering the lateral opening of said fastener guide to reach said second position as said door member is closed in case that said second kind of the connected fasteners is disposed within the fastener guide channel.

* * * * *